US006725853B2

(12) United States Patent
Foddrill

(10) Patent No.: US 6,725,853 B2
(45) Date of Patent: Apr. 27, 2004

(54) ATTACHABLE ARROW HOLDER

(76) Inventor: Mation Edward Foddrill, P.O. Box 199, Walker Valley, NY (US) 12588

( * ) Notice: Subject to any disclaimer, the term of this patent is extended or adjusted under 35 U.S.C. 154(b) by 0 days.

(21) Appl. No.: 10/205,325

(22) Filed: Jul. 25, 2002

(65) Prior Publication Data

US 2003/0037779 A1 Feb. 27, 2003

Related U.S. Application Data

(60) Provisional application No. 60/314,554, filed on Aug. 24, 2001.

(51) Int. Cl.[7] ..... F41B 5/06
(52) U.S. Cl. ..... 124/86; 124/25.5; 224/916
(58) Field of Search ..... 124/25.5, 25.7, 124/86; 224/916

(56) References Cited

U.S. PATENT DOCUMENTS 2,746,658 A * 5/1956 Freid
2,954,764 A * 10/1960 Stinson
2,969,898 A * 1/1961 Ramsey
2,999,620 A * 9/1961 Haggard
3,366,101 A * 1/1968 Saunders
3,595,214 A * 7/1971 O'Malley et al.
4,073,328 A * 2/1978 Franklin
5,409,109 A * 4/1995 Smith
5,593,121 A * 1/1997 Tackett
6,006,734 A 12/1999 Sodaro ..... 124/86
6,328,189 B1 * 12/2001 Norden

* cited by examiner

*Primary Examiner*—John A. Ricci
(74) *Attorney, Agent, or Firm*—Walter J. Tencza, Jr.

(57) ABSTRACT

An apparatus is provided comprising a first device for holding one or more arrows and a second device fixed to the first device for attaching the first device and the one or more arrows to an archery bow. The second device is comprised of a flexible material, which can be wrapped around a trunk of the archery bow to attach the second device and the first device to the archery bow. A second apparatus may be provided which is identical to the first apparatus. The second apparatus may be comprised of a third device which can be used together with the first device for holding one or more arrows; and a fourth device fixed to the third device for attaching the third device and the one or more arrows to an archery bow.

20 Claims, 6 Drawing Sheets

ATTACHABLE ARROW HOLDER

CLAIM FOR PRIORITY OF PROVISIONAL APPLICATION

This application hereby claims the priority of provisional patent application No. 60/314,554 filed on Aug. 24, 2001, the inventor and applicant being Marion Edward Foddrill, which is the same inventor and applicant as for the present application.

FIELD OF THE INVENTION

The present invention relates to the field of archery. In particular, the present invention relates to methods and apparatus for holding arrows.

BACKGROUND OF THE INVENTION

Various patents in the prior art provide "quivers", which are cases or apparatus for carrying or holding arrows. For example, U.S. Pat. No. 6,006,734 to Sodaro, provides a quiver assembly 10 comprised of an arrow hood 200 and an arrow shaft holder 300. The quiver assembly 10 can be fixed to an archery bow through an archery bow mounting assembly 400. As shown in FIGS. 11 and 12 of that patent, a base element 410 can be mounted to an archery bow 40 through holes 425 in the base element 410. The quiver assembly 10 of U.S. Pat. No. 6,006,734 to Sodaro is a one piece unit held together by connecting element 100. A bottom portion of an arrow, such as arrow 20 in FIG. 2, can be inserted into a slot, such as slot 310 and the arrowhead 30 can be inserted into the arrow hood 200 as shown in FIG. 2. Sodaro undesirably requires that the base element be screwed into the archery bow 40.

SUMMARY OF THE INVENTION

The present invention provides an improved method and apparatus for holding arrows. In one embodiment, an apparatus is provided comprising a first device for holding one or more arrows and a second device fixed to the first device for attaching the first device and the one or more arrows to an archery bow. The second device is comprised of a flexible material, which can be wrapped around a trunk of the archery bow to attach the second device and the first device to the archery bow.

The second device may be comprised of rubber. The second device may be comprised of a first attachment device section and a second attachment device section, wherein when the flexible material is wrapped around the trunk of the archery bow, the first attachment device section can be attached to the second attachment device section to attach the apparatus to the archery bow. The first device may have one or more holes into which a corresponding one or more rods of a corresponding one or more arrows can be inserted. The first device may have one or more openings, each of the one or more openings lying adjacent to a corresponding one of the one or more holes. Each of the one or more holes may have a diameter which is greater than a dimension of the corresponding one or more openings. The one or more openings may include a first, second, third, and fourth opening, and the one or more holes include a first, second, third, and fourth hole.

The first, second, third, and fourth openings together may define a substantially trapezoidal or a substantially square shape. Similarly the first, second, third, and fourth holes may together define a substantially trapezoidal or a substantially square shape.

In at least one embodiment of the present invention, a second apparatus may be provided which is identical to the first apparatus. The second apparatus may be comprised of a third device for holding one or more arrows; and a fourth device fixed to the third device for attaching the third device and the one or more arrows to an archery bow. The fourth device may be comprised of a flexible material, which can be wrapped around a trunk of the archery bow to attach the fourth device and the third device to the archery bow. In one embodiment of the present invention a first arrow can be inserted into the first device and the third device. The second device may be attached to the trunk of the archery bow near the bottom of the trunk of the archery bow, and the fourth device may be attached to the trunk of the archery bow near the top of the trunk of the archery bow.

The present invention also discloses a method comprising the steps of inserting an arrow into the first device, the first device fixed to the second device; and attaching the second device to the archery bow by wrapping a portion of the second device around a trunk of the archery bow. The method may also include inserting the arrow into the third device, the third device fixed to a fourth device; and attaching the fourth device to the archery bow by wrapping a portion of the fourth device around the trunk of the archery bow.

DETAILED DESCRIPTION OF THE DRAWINGS

Figure 1:
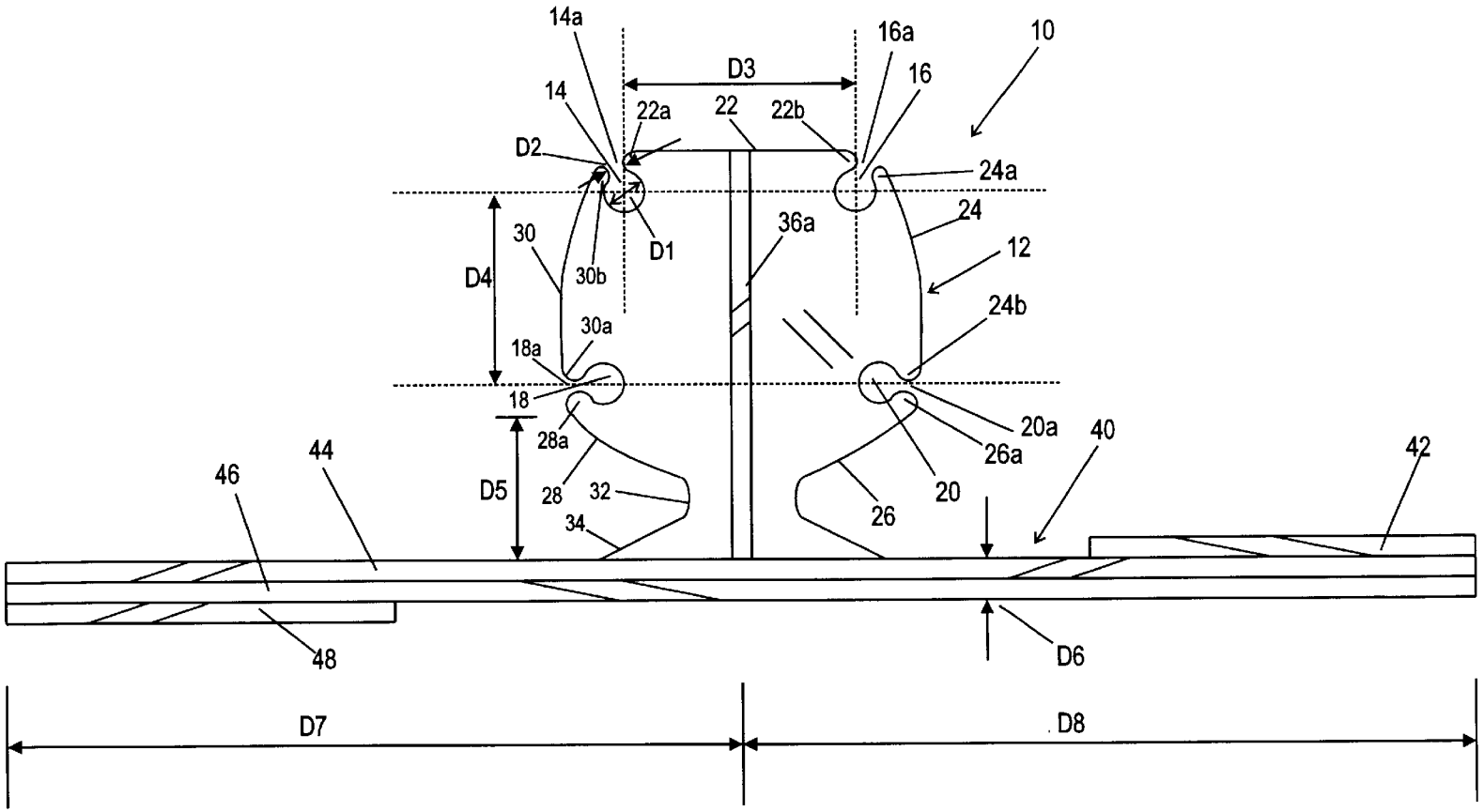
FIG. 1 shows a front view of an apparatus for holding one or more arrows and attaching one or more arrows to an archery bow.
Figure 2:
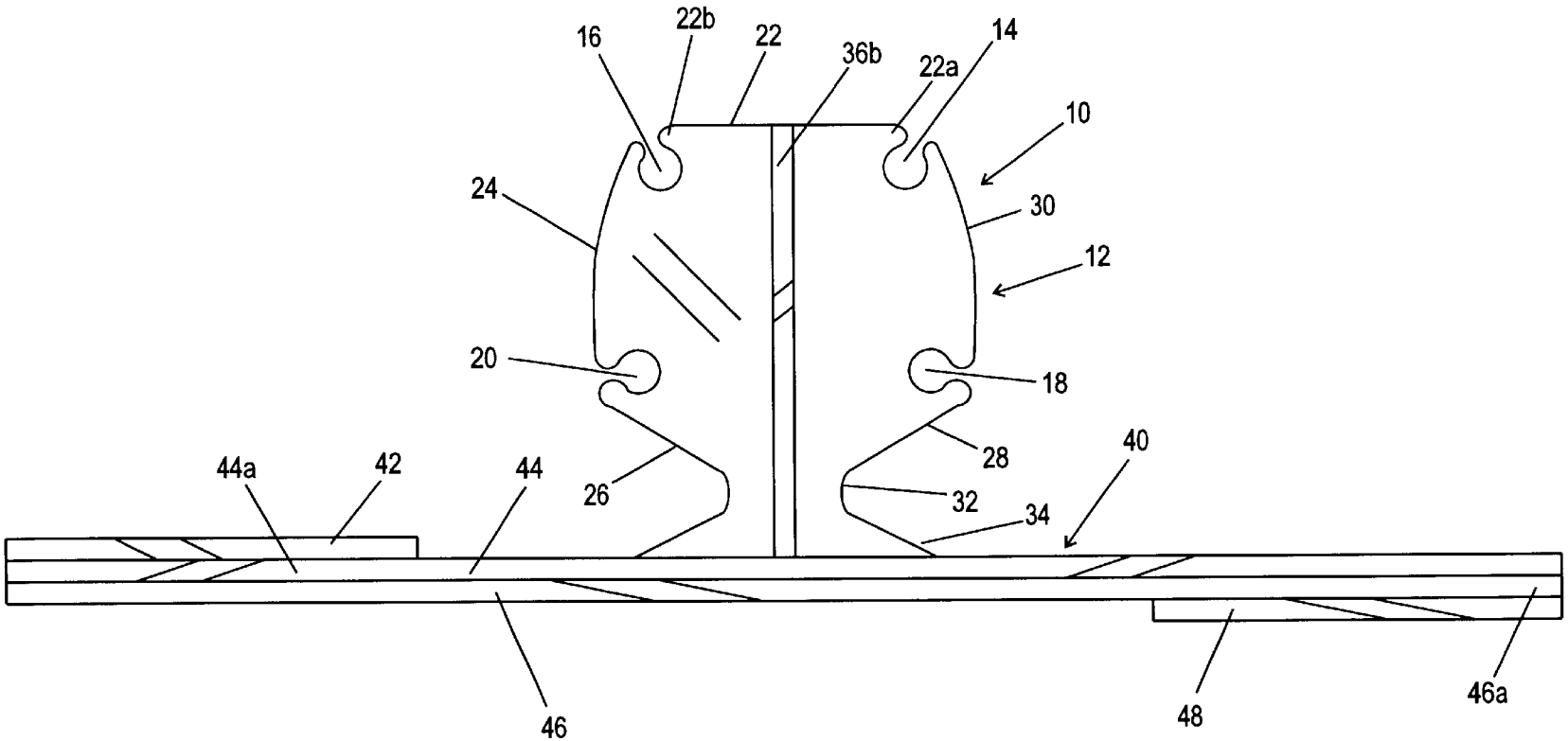
FIG. 2 shows a back view of the apparatus of FIG. 1.
Figure 4:
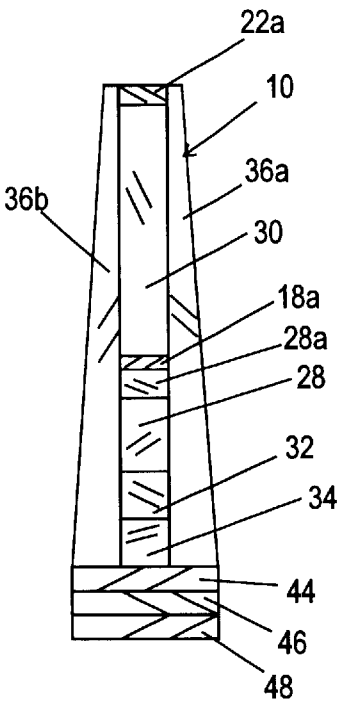
FIG. 4 shows a left side view of the apparatus of FIG. 1.
Figure 3:
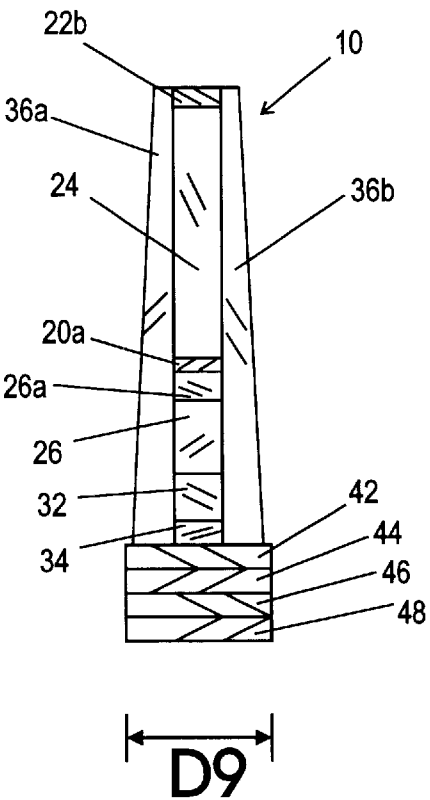
FIG. 3 shows a right side view of the apparatus of FIG. 1.
Figure 5:
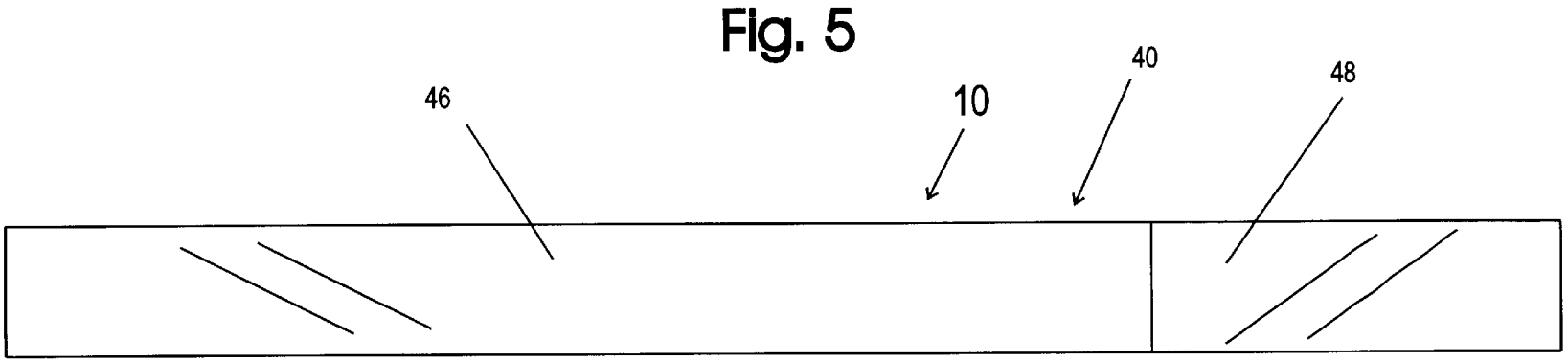
FIG. 5 shows a bottom view of the apparatus of FIG. 1.
Figure 6:
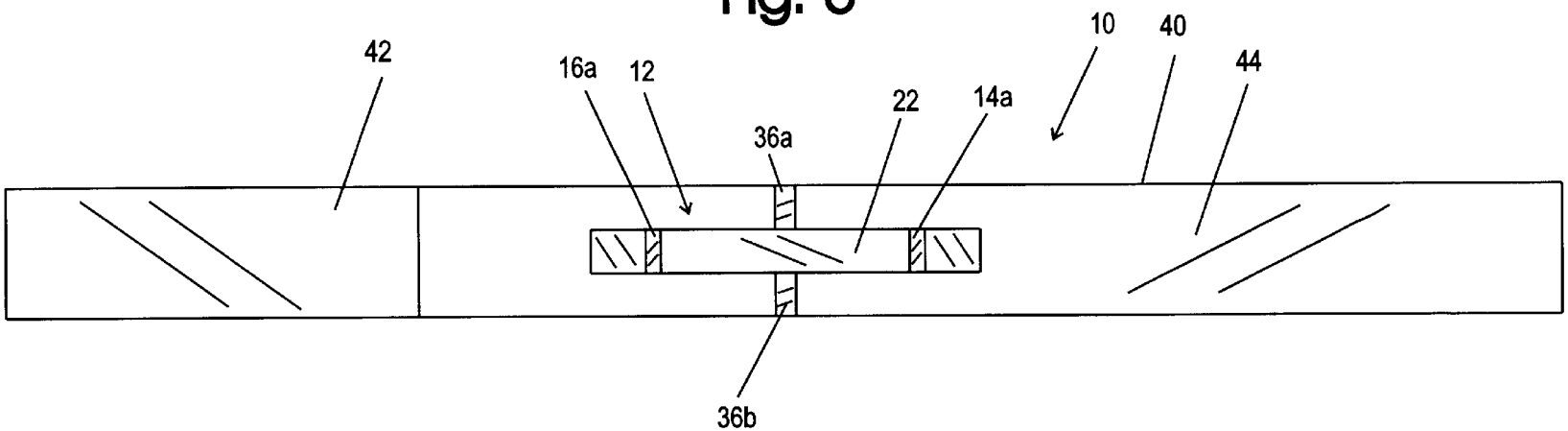
FIG. 6 shows a top view of the apparatus of FIG. 1.

FIG. 1 shows a front view of an apparatus 10 for holding one or more arrows and attaching one or more arrows to an archery bow. FIG. 2 shows a back view of the apparatus 10 of FIG. 1. FIG. 3 shows a right side view of the apparatus 10 of FIG. 1. FIG. 4 shows a left side view of the apparatus 10 of FIG. 1. FIG. 5 shows a bottom view of the apparatus 10 of FIG. 1. FIG. 6 shows a top view of the apparatus 10 of FIG. 1.

The apparatus 10 includes a device 12 for holding one or more arrows and a device 40 for attaching the device 12 to an archery bow. The device 12 includes holes 14, 16, 18, and 20. Each hole is substantially cylindrical except for a narrow opening. Holes 14, 16, 18, and 20 have narrow openings 14*a*, 16*a*, 18*a*, and 20*a* respectively. The cylindrical portion of each hole 14, 16, 18, and 20 has a diameter of D1, which may be 9/32 of an inch. The narrow opening portion of each hole has a width of D2, which may be 3/16 of an inch. The narrow opening width, D2, is set to be smaller than the diameter of an arrow rod, such as the diameter D10 of the arrow rod 302 of arrow 300 in shown in FIG. 7. The diameter D1, of the holes 14, 16, 18, and 20, may be about equal to the diameter D10 of the arrow rod 302.

The device 12 also includes sides 22, 24, 26, 28, and 30. Side 22 has curved extensions 22*a* and 22*b* and its two ends;

side 24 has curved extensions 24*a* and 24*b* and its two ends; and side 30 has curved extension 30*a* and 30*b* at its two ends. Side 26 has a curved extension 26*a* on one end and is connected to a section 32 on its other end. Side 28 has a curved extension 28*a* on one end and is connected to a section 32 on its other end. Section 32 is connected to section 34. The section 34 of the portion 12 is connected to the portion 40. Spines or support members 36*a* and 36*b* are provided to support the part of device 12 which includes sides 22, 24, 26, 28, and 30 and sections 32 and 34.

Device 40 is comprised a first attachment device section 42. The first attachment device may be a strip of flexible material. The first attachment device section 42 may be comprised of hooks or loops or one portion of a VELCRO (trademarked) system. The device 40 is also comprised of sections 44 and 46, which may be rubber strips of flexible material. A single section or a single layer may replace sections 44 and 46. The device 40 is also comprised of a second attachment device 48 which may be a strip of flexible material. The second attachment device 48 should be capable of being attached to the first attachment device 42. The second attachment device 48 may be hooks or loops or the second portion of a VELCRO (trademarked) system. The width of sections 42, 44, 46, and 48 may be D9 shown in FIG. 3, which may be three quarters of an inch.

The distance, D3, between the centers of holes 14 and 16 may be one and one half inches. The distance D4 between a dashed line going through the center of hole 14 and a dashed line going through the center of hole 18 may be one and one quarter inches. The distance between the centers of holes 18 and 20 may be one and three quarters of an inch. The device 40 may have a total length of seven inches, D7+D8, D7 and D8 may each be three and one half inches. The sections 44 and 46 may have a total thickness of D6, which may be one eighth of an inch. The extension 28*a* may be a distance of D5 or ⅝ of an inch from section 44. Each of holes 14, 16, 18, and 20 may have a diameter of 9/32 inches.

FIGS. 1–6 shows the apparatus 10 in an open and unattached state.

Figure 7:
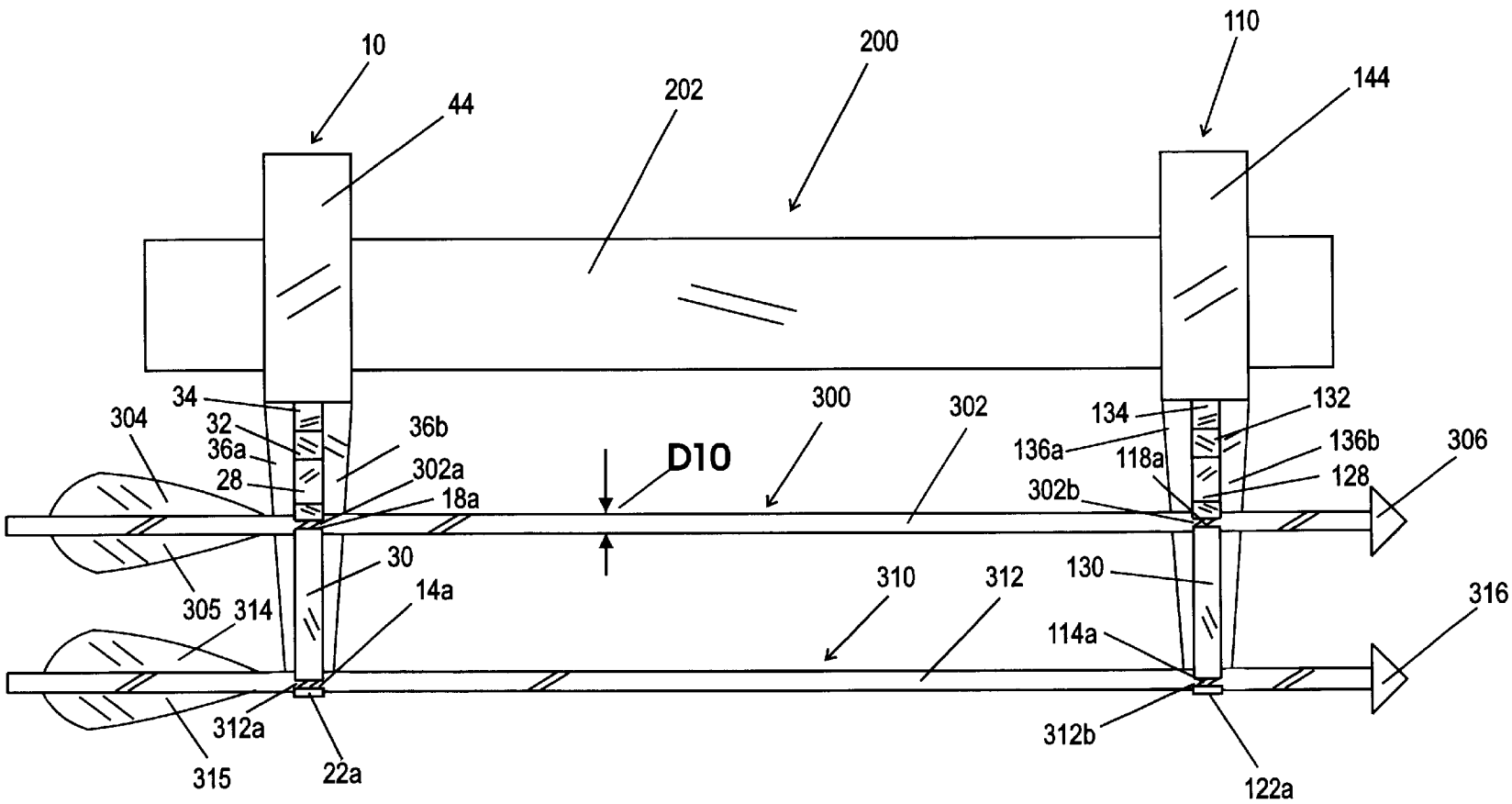
FIG. 7 shows a side view of the apparatus of FIG. 1 and an identical apparatus, each of which is in an attached state, holding two arrows and attached to an archery bow.
Figure 8:
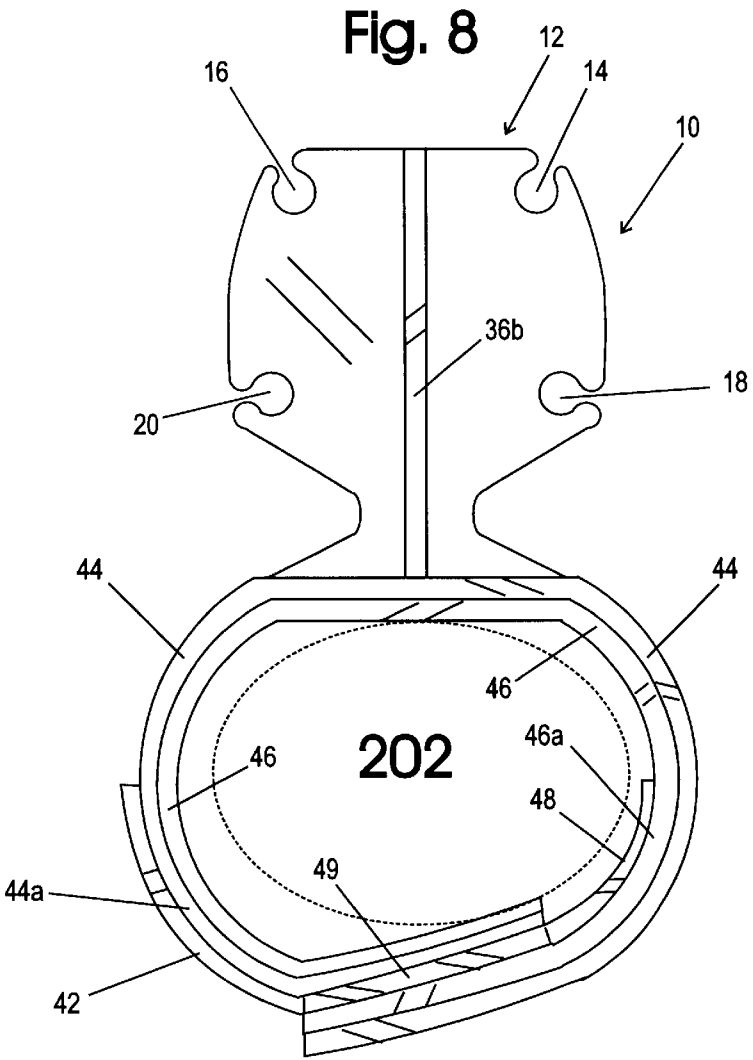
FIG. 8 shows a back view of the apparatus of FIG. 1 in a closed state.

FIG. 7 shows a side view of the apparatus 10 of FIG. 1 and an identical apparatus 110, each of which is in an attached state, holding two arrows 300 and 310 and attached to an archery bow 200. FIG. 8 shows a back view of the device 10 of FIG. 1 in a closed state. The arrows 300 and 310 include bottom wings 304–305 and 314–315 respectively. The arrows 300 and 310 also include arrowheads 306 and 316, and rods 302 and 312, respectively. The apparatus 110 may include all the same components as the apparatus 10. The apparatus 110 may include, for example, components 114*a*, 118*a*, 122*a*, 128, 130, 132, 134, 136*a*, and 136*b*, which are shown in FIG. 7 and which are identical to similarly numbered components 14*a*, 18*a*, 22*a*, 28, 30, 32, 34, and 36, respectively.

In FIG. 7, a portion 302*a* near the bottom of the rod 302 of the arrow 300 is shown in the hole 18 through the narrow opening 18*a*. Also a portion 302*b* near the arrowhead 306 of the rod 302 of the arrow 300 is shown in hole 118 through the narrow opening 118*a*. Similarly, a portion 312*a* near the bottom of the rod 312 of the arrow 310 is shown in the hole 14 through the narrow opening 14*a*. Also a portion 312*b* near the arrowhead 316 of the rod 312 of the arrow 310 is shown in hole 114 through the narrow opening 114*a*. FIG. 7 shows the apparatus 10 attached to a bottom portion of a trunk 202 of the archery bow 200 and the apparatus 110 attached to a top portion of the trunk 202 of the archery bow 200.

In operation, apparatus 10 and 110 are first attached to the trunk 202 of the archery bow 200 in the positions shown in FIG. 7. Apparatus 10 is attached by wrapping the device 40 around the trunk 202 of the archery bow 200 as shown by FIG. 8 and by attaching attachment device 42 to attachment device 48 to form portion 49, which is a combination of part of attachment device, 42 linked and attached to attachment device 48. Apparatus 110 is attached to the trunk 202 of the archery bow 200 in a manner similar to apparatus 10.

After the apparatus 10 and 110 have been attached to the trunk 202 of the bow 200 as shown by FIGS. 7 and 8, arrows 300 and 310 may then be inserted into the apparatus 10 and 110 as shown in FIG. 7. The bottom portion 302*a* is pushed into the opening 18, which at first causes the opening 18*a*, i.e. the distance between extensions 28*a* and 30*a*, to become larger. Apparatus 10 can generally be made of rubber so that it can expand and contract. The bottom portion 302*a* passes through the narrow opening 18*a* and then slips into the opening 18. When the bottom portion 302*a* lies completely inside the opening 18, the narrow opening 18*a* contracts back to its original dimension of D2. The top portion 302*b* of the arrow 300 is placed in the opening 118 in a similar manner. The bottom portion 312*a* and the top portion 312*b* of the arrow 312 are placed into the openings 14 and 114 in a similar manner.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first device for holding one or more arrows;

a second device fixed to the first device for attaching the first device and the one or more arrows to an archery bow;

a first supporting member;

wherein the first supporting member is fixed to and substantially perpendicular to the first device;

wherein the first supporting member is fixed to and substantially perpendicular to the second device; and wherein the second device is comprised of a flexible material, which can be wrapped around a trunk of the archery bow to attach the second device and the first device to the archery bow.

2. The apparatus of claim 1 further comprising a second supporting member; and wherein the second supporting member is fixed to and substantially perpendicular to the first device;

wherein the second supporting member is fixed to and substantially perpendicular to the second device; and wherein the first supporting member is connected to the first device on a first side of the first device and the second supporting member is connected to the first device on a second side of the first device, wherein the first side is opposite the second side.

3. An apparatus comprising:

a first device for holding one or more arrows;

a second device fixed to the first device for attaching the first device and the one or more arrows to an archery bow;

wherein the second device is comprised of a flexible material which can be wrapped around a trunk of the archery bow to attach the second device and the first device to the archery bow; and wherein the first device has plurality of holes into which a corresponding one or more rods of a corresponding one or more arrows can be inserted; and wherein the first device is supported by a first supporting member which is substantially perpedicular to the first device; and wherein the plurality of holes are symmetrically arranged with respect to the first supporting member so that the number of holes lying to the left of the first supporting member is equal to the number of holes lying to the right of the first supporting member.

4. The apparatus of claim 3 wherein the second device is comprised of rubber.

5. The apparatus of claim 3 wherein the second device is comprised of a first attachment device section and a second attachment device section, wherein when the flexible material is wrapped around the trunk of the archery bow, the first attachment device section can be attached to the second attachment device section to attach the apparatus to the archery bow.

6. The apparatus of claim 3 wherein the first device has one or more openings, each of the one or more openings lying adjacent to a corresponding one of the one or more holes;

each of the one or more holes has a diameter which is greater than a dimension of the corresponding one or more openings.

7. The apparatus of claim 6 wherein the one or more openings include a first, second, third, and fourth opening;

and the one or more holes include a first, second, third, and fourth hole.

8. The apparatus of claim 7 wherein the first, second, third, and fourth openings together define a substantially square shape;

and the first, second, third, and fourth holes together define a substantially square shape.

9. The apparatus of claim 7 wherein the first, second, third, and fourth openings together define a substantially trapezoidal shape; and the first, second, third, and fourth holes together define a substantially trapezoidal shape.

10. An apparatus comprising:

a first device for holding one or more arrows;

a second device fixed to the first device for attaching the first device and the one or more arrows to an archery bow;

wherein the second device is comprised of a flexible material, which can be wrapped around a trunk of the archery bow to attach the second device and the first device to the archery and further comprised of a third device for holding one or more arrows;

a fourth device fixed to the third device for attaching the third device and the one or more arrows to an archery bow;

wherein the fourth device is comprised of a flexible material, which can be wrapped around a trunk of the archery bow to attach the fourth device and the third device to the archery bow;

further comprising a first arrow, which can be inserted into the first device and the third device.

11. The apparatus of claim 10 further comprising the archery bow;

wherein the second device is attached to the trunk of the archery bow near the bottom of the trunk of the archery bow; and wherein the fourth device is attached to the trunk of the archery bow near the top of the trunk of the archery bow.

12. The apparatus of claim 11 further comprising a second arrow, which can be inserted into the first device and the third device.

13. A method comprising the steps of inserting an arrow into a first device, the first device fixed to a second device; and attaching the second device to an archery bow by wrapping a portion of the second device around a trunk of the archery bow.

14. The method of claim 13 wherein the second device includes a first attachment device and a second attachment device and the step of attaching the second device to an archery bow includes attaching the first attachment device to the second attachment device.

15. The method of claim 14 wherein the first attachment device is comprised of hooks; and the second attachment device is comprised of loops.

16. The method of claim 13 wherein the second device is comprised of rubber.

17. The method of claim 13 wherein the first device has a one or more holes;

and further comprising inserting one or more rods of a corresponding one or more arrows into the corresponding one or more holes.

18. The method of claim 17 wherein the first device has one or more openings, each of the one or more openings lying adjacent to a corresponding one of the one or more holes;

each of the one or more holes has a diameter which is greater than a dimension of the corresponding one or more openings;

and wherein the step of inserting one or more rods of a corresponding one or more arrows into the corresponding one or more holes includes inserting the one or more rods into a corresponding one or more openings.

19. The method of claim 13 further comprised of inserting the arrow into a third device, the third device fixed to a fourth device; and attaching the fourth device to an archery bow by wrapping a portion of the fourth device around the trunk of the archery bow.

20. The method of claim 19 wherein the second device is attached to the trunk of the archery bow near the bottom of the trunk of the archery bow; and the fourth device is attached to the trunk of the archery bow near the top of the trunk of the archery bow.

* * * * *